US008671845B2

(12) United States Patent
Xu et al.

(10) Patent No.: US 8,671,845 B2
(45) Date of Patent: Mar. 18, 2014

(54) CENTRAL SUSPENSION DEVICE, WAGON BOGIE AND EXPRESS RAILWAY WAGON

(75) Inventors: Shifeng Xu, Qiqihar (CN); Wendong Shao, Qiqihar (CN); Haibin Hu, Qiqihar (CN); Yuebin Yu, Qiqihar (CN); Lidong Li, Qiqihar (CN); Kewei Lv, Qiqihar (CN); Shuming Xing, Qiqihar (CN); Derong Zhang, Qiqihar (CN); Xinqiang Liu, Qiqihar (CN)

(73) Assignee: Qiqihar Railway Rolling Stock Co., Ltd., Qiqihar (CN)

( * ) Notice: Subject to any disclaimer, the term of this patent is extended or adjusted under 35 U.S.C. 154(b) by 0 days.

(21) Appl. No.: 13/597,209

(22) Filed: Aug. 28, 2012

(65) Prior Publication Data

US 2012/0318165 A1 Dec. 20, 2012

Related U.S. Application Data

(63) Continuation of application No. PCT/CN2011/084467, filed on Dec. 22, 2011.

(30) Foreign Application Priority Data

Jan. 1, 2011 (CN) ..... 2011 1 0000333

(51) Int. Cl.
*B61F 5/08* (2006.01)

(52) U.S. Cl.
USPC ..... 105/197.05; 105/198.2

(58) Field of Classification Search
CPC ..... B61F 5/08; B61F 5/12; B61F 5/125
USPC ..... 105/197.05, 198.2, 197.2, 198.4
See application file for complete search history.

(56) References Cited

U.S. PATENT DOCUMENTS 1,924,237 A * 8/1933 Glascodine ..... 267/294
1,936,389 A * 11/1933 Hallquist ..... 267/292

(Continued)

FOREIGN PATENT DOCUMENTS

CN 2546292 Y 4/2003
CN 2851046 Y 12/2006

(Continued)

OTHER PUBLICATIONS

International Search Report of International Application No. PCT/CN2011/084467, dated Apr. 5, 2012.

*Primary Examiner* — Zachary Kuhfuss
(74) *Attorney, Agent, or Firm* — J.C. Patents

(57) ABSTRACT

A central suspension device, a wagon bogie and an express railway wagon, wherein the central suspension device is arranged between a frame and a bolster of the wagon bogie and comprises a rubber-metal pad spring group composed of at least two rubber-metal pad springs, a bottom end of each rubber-metal pad spring is connected with the frame, a top end of at least one rubber-metal pad spring of the rubber-metal pad spring group is connected with the bolster, and a gap exists between the top end of at least one rubber-metal pad spring and the bolster. The central suspension device has multiple stages of rigidities in the transverse and vertical directions, so that the different rigidities can be mutually shifted conveniently on the empty vehicle condition and the heavy-load condition of the vehicle, therefore, the central suspension device is applicable to express railway vehicles for safe and stable running.

9 Claims, 11 Drawing Sheets

(56) References Cited

U.S. PATENT DOCUMENTS

| | | | | | |
|---|---|---|---|---|---|
| 2,538,380 | A | * | 1/1951 | Pflager | 105/190.2 |
| 2,674,449 | A | * | 4/1954 | Tucker | 267/3 |
| 2,747,519 | A | * | 5/1956 | Heater et al. | 105/198.4 |
| 3,762,694 | A | * | 10/1973 | MacDonnell | 267/3 |
| 3,865,045 | A | * | 2/1975 | Jones, Jr. | 105/199.1 |
| 4,109,586 | A | * | 8/1978 | Briggs et al. | 105/224.06 |
| 4,771,704 | A | * | 9/1988 | Gronlund et al. | 105/193 |

FOREIGN PATENT DOCUMENTS

| | | |
|---|---|---|
| CN | 101830235 A | 9/2010 |
| JP | 2009-197986 | 9/2009 |
| WO | WO2006/021360 | 3/2006 |

* cited by examiner

CENTRAL SUSPENSION DEVICE, WAGON BOGIE AND EXPRESS RAILWAY WAGON

CROSS-REFERENCE TO RELATED APPLICATIONS

The application is a continuation of International Application No. PCT/CN2011/084467, filed on Dec. 22, 2011, which claims priority to Chinese Patent Application No. 201110000333.0, filed on Jan. 1, 2011, both of which are hereby incorporated by reference in their entireties.

FIELD OF THE TECHNOLOGY

The invention relates to a technology of wagon bogies and, in particular, to a central suspension device, a wagon bogie and an express railway wagon.

BACKGROUND

An express wagon bogie is an important part of an express railway freight transport vehicle, and the structural performances of the express wagon bogie play an important role in the running smoothness, stability and safety of the vehicle. By means of the express wagon bogie, the vehicle can transmit various loads and action forces from a vehicle body to wheels as well as from tracks to the vehicle body and ensure that the axle load is distributed uniformly. At present, the express wagon bogies at home and abroad generally adopt two-stage of suspension structures, that is, a primary axle box positioning suspension device and a secondary central suspension device; the general two-stage suspension structures are adopted to guarantee the high-speed running of the vehicle, wherein the secondary central suspension device is a suspension device arranged between a frame and a bolster of the bogie and is used for reducing impact, attenuating vibration and improving the running stability of the vehicle.

FIG. 1 is a top view of the structure of a wagon bogie in the prior art, and FIG. 2 is a front view of the structure of the wagon bogie in FIG. 1. As shown in FIG. 1 and FIG. 2, a central suspension device in the railway wagon bogie mainly comprises a frame 3, a bolster 2, a longitudinal traction connecting rod device 4 and a rubber-metal pad spring 1. During the running of the vehicle, the transmission sequence of the longitudinal traction force and the braking force of the vehicle is that: the longitudinal force and the braking force from a bogie center plate 9 are transmitted to the bolster 2, then to the longitudinal traction connecting rod device 4 via the second traction connecting rod base 41 on the bolster 2, then to the first traction connecting rod base 42 on the frame 3 via the longitudinal traction connecting rod device 4, then to the frame 3 via the first traction connecting rod base 42, then to an axle box spring group 8 of an axle box suspension device via the frame 3, and finally to a wheel set via the axle box spring group 8. The transmission sequence of the transverse force of the vehicle is that: the transverse force from the bogie center plate 9 is transmitted to the bolster 2, then to the longitudinal traction connecting rod device 4 via the bolster 2, then to the frame 3 via the longitudinal traction connecting rod device 4 and the rubber-metal pad spring 1, then to the axle box spring group 8 via the frame 3, and finally to the wheel set via the axle box spring group 8; and the transmission sequence of the transverse force on the wheel set of tracks is that: the transverse force is transmitted to the frame 3 via the wheel set, then to the longitudinal traction connecting rod device 4 and the rubber-metal pad spring 1 via the frame 3, and finally to the bolster 2 after being buffered by the longitudinal traction connecting rod device 4 and the rubber-metal pad spring 1.

FIG. 3 is a schematic structural diagram of the central suspension device in FIG. 1, and FIG. 4 is a schematic structural diagram of rubber-metal pad spring in FIG. 3. As shown in FIG. 3 and FIG. 4, the frame 3 and the bolster 2 are connected together via the rubber-metal pad spring 1 in the vertical direction, and the frame 3 and the bolster 2 are connected together via the longitudinal traction connecting rod device 4 in the longitudinal direction. Each rubber-metal pad spring 1 comprises a rubber body 15, an upper liner 16, an upper positioning pin 17, a lower liner 18 and a lower positioning pin 19. The upper liner 16 and the upper positioning pin 17 are welded together, and the upper positioning pin 17 is inserted into an opening of a lower cover plate of the bolster 2, so that the rubber-metal pad spring 1 and the bolster 2 are connected in a positioning way; the lower liner 18 and the lower positioning pin 19 are welded together, and the lower positioning pin 19 is inserted into an opening of an upper cover plate of the frame 3, so that the rubber-metal pad spring 1 and the frame 3 are connected in a positioning way. When the vehicle provided with the central suspension device with such structure is running, the rubber-metal pad spring is subjected to compression deformation under the action of vertical load and is subjected to shearing deformation under the action of transverse load, therefore, the vertical vibration and the transverse impact can be buffered so as to reduce the dynamic stress. However, for the rubber-metal pad spring in the central suspension device, the rubber-metal pad spring with a larger rigidity structure is needed in the transverse direction in order to guarantee the vertical carrying capacity, but the running stability of an empty vehicle is affected by the increased transverse rigidity; meanwhile, the vertical deflection decreases with the increase of the transverse rigidity, so that the adaptability of the vehicle to the tracks is reduced during the high-speed running, thereby resulting in the problem that the vehicle derails easily.

FIG. 5 is a schematic structural diagram of the longitudinal traction connecting rod device in FIG. 1. As shown in FIG. 5, the longitudinal force and the braking force are transmitted to a rubber pad assembly 47 via the second traction connecting rod base 41 on the bolster 2, then to a traction connecting rod 43 via a nut 44, then to a rubber pad assembly at the other end of the traction connecting rod 43 via the traction connecting rod 43, and then to the first traction connecting rod base 42 on the frame 3, and finally to the frame 3, wherein an inner cylinder 46 is a non-metal wear-resistant piece, and a gasket 45 is used for preventing the nut 44 from loosening. When the longitudinal traction connecting rod device with the structure is under the transverse acting force transmitted via the bolster 2 from the bogie center plate 9, the rubber pad assembly 47 is deformed after being twisted and compressed, the compression rigidity is larger, and the transverse additional rigidity of the bogie is increased by about 30%, so that the dynamics performance of the vehicle is seriously affected, thereby not being beneficial for the running of the empty vehicle.

SUMMARY

The present invention provides a central suspension device, a wagon bogie and an express railway wagon for solving the problem that the central suspension device runs unstably when in light loading due to the large transverse rigidity and the small vertical deflection.

To achieve the above objective, embodiments of the present invention provide a central suspension device comprising a frame, a bolster and a longitudinal traction connecting rod device. One end of the longitudinal traction connecting rod device is connected with the frame, and the other end of the longitudinal traction connecting rod device is connected with the bolster. The central suspension device further comprises a rubber-metal pad spring group composed of at least two rubber-metal pad springs, the bottom end of each rubber-metal pad spring is connected with the frame, the top end of at least one rubber-metal pad spring in the rubber-metal pad spring group is connected with the bolster, and a gap exists between the top end of at least one rubber-metal pad spring and the bolster.

Embodiments of the present invention further provide another central suspension device arranged between a frame and a bolster of the wagon bogie. The central suspension device comprises a rubber-metal pad spring group composed of at least two rubber-metal pad springs, the bottom end of each rubber-metal pad spring is connected with the frame, the top end of at least one rubber-metal pad spring in the rubber-metal pad spring group is connected with the bolster, and a gap exists between the top end of at least one rubber-metal pad spring and the bolster.

Embodiments of the present invention further provide a wagon bogie comprising an axle box suspension device and the above central suspension device. The axle box suspension device is connected with the central suspension device via a frame.

In one embodiment, the longitudinal traction connecting rod device comprises two spherical hinge assemblies and a traction connecting rod connected between the two spherical hinge assemblies, wherein each spherical hinge assembly comprises a spherical hinge shaft and a spherical hinge sleeve, a convex spherical surface is arranged at the middle part of the spherical hinge shaft, the spherical hinge sleeve is provided with a concave spherical surface, the convex spherical surface and the concave spherical surface are articulated and matched with each other, the end part of the spherical hinge shaft of one spherical hinge assembly is connected with a first traction connecting rod base arranged on the frame, the end part of the spherical hinge shaft of the other spherical hinge assembly is connected with a second traction connecting rod base arranged on the bolster, and the spherical hinge sleeve is connected with the traction connecting rod.

In another embodiment, a bogie center plate is arranged in the center of the bolster, the bolster is provided with two side bearings which are symmetrically arranged relative to the bogie center plate, and a center distance between centers of the two side bearings is more than 1520 mm.

Embodiments of the present invention further provide an express railway wagon comprising the above described wagon bogie.

The technical effect of one aspect of the invention is that: the rubber-metal pad spring group has two or more stages of rigidities in both the vertical and transverse directions due to the arrangement of the plurality of the rubber-metal pad springs with different free heights. The vertical deflection is relatively large on the light-load or no-load operation condition so that the safety of the vehicle running at a high speed and the adaptability of the vehicle to the tracks are improved, and the transverse rigidity is smaller so that the dynamics stability of the empty vehicle is higher; the transverse rigidity is larger on the heavy-load operation condition, so that the carrying capability of the rubber-metal pad spring is improved, the requirement on the transverse rigidity is met, and the safety of the vehicle running at a high speed is improved.

The technical effect of another aspect of the invention is that: the transmitting of the acting force between the bolster and the frame is realized by the longitudinal traction connecting rod device composed of the spherical hinge assemble, so that the shearing deformation in the transverse direction is reduced so as to provide smaller transverse rigidity and to be beneficial for reducing the transverse additional rigidity of the bogie, in addition, the installation and the maintenance are facilitated, and the installation difficulty and the manufacture cost are reduced.

The technical effect of still another aspect of the invention is that: the distance between centers of the two side bearings is set more than 1520 mm, so that the moment against turning of each side bearing is effectively increased; due to the increased moment against turning of each side bearing, the maximum running speed of the vehicle is increased, and a smaller anti-roll tilt angle and a larger roll restoring moment can further be acquired; therefore, the roll of the vehicle body can be prevented effectively, and the running safety of the vehicle is improved.

DETAILED DESCRIPTION

Combined with the attached drawings, specific embodiments of the invention are described in details. The embodiments are described by taking the two stages of rigidities in the transverse and vertical directions as the example, the present invention is not limited to these embodiments, and persons skilled in the art can make proper changes and modifications according to practical applications.

Figure 6:
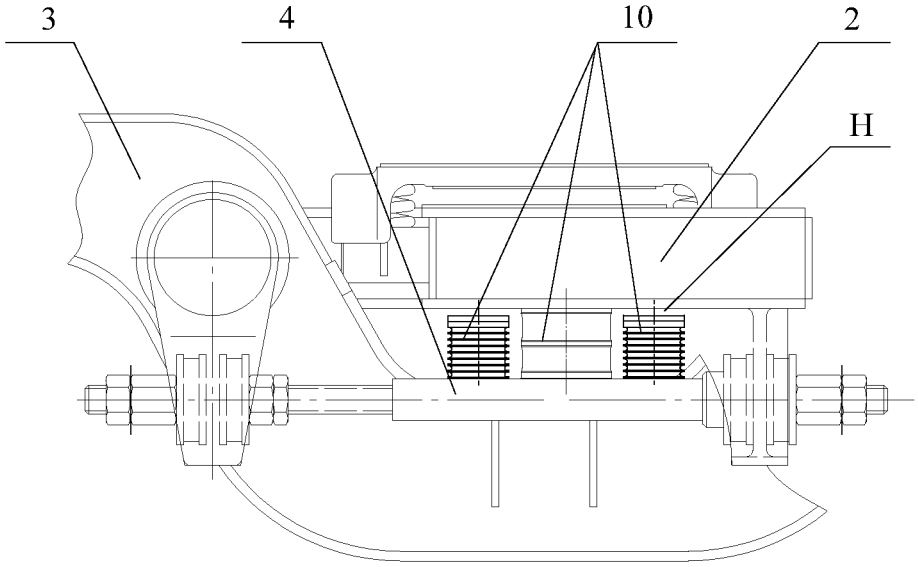
FIG. 6 is a front view of the central suspension device according to Embodiment I of the present invention.

FIG. 6 is a front view of the central suspension device according to Embodiment I of the present invention. As shown in FIG. 6, the central suspension device of the embodiment comprised a frame 3, a bolster 2, a longitudinal traction connecting rod device and a rubber-metal pad spring group 10 composed of three rubber-metal pad springs. One end of the longitudinal traction connecting rod device 4 is connected with the frame 3, and the other end of the longitudinal traction connecting rod device 4 is connected with the bolster 2. The bottom end of each rubber-metal pad spring is connected with the frame 3; and in the rubber-metal pad spring group 10, the top end of the rubber-metal pad spring in the middle is connected with the bolster 2, and a gap H exists between the top end of each of the two rubber-metal pad springs at two sides and the bolster 2.

In this embodiment, the rubber-metal pad spring group 10 between the frame 3 and the bolster 2 comprises three rubber-metal pad springs, wherein the free height of the rubber-metal pad spring in the middle is larger, and the two ends of the rubber-metal pad spring in the middle are connected with the frame and the bolster on the light-load or no-load condition; the free height of each of the two rubber-metal pad springs at two sides can be smaller, so that a gap is left between the top end of each of the two rubber-metal pad springs at two sides and the bolster on the light-load or no-load condition, so that the two rubber-metal pad springs at two sides make no contribution to the rigidity of the whole rubber-metal pad spring; and the top end of one of the two springs at two sides or the two top ends of the two springs at two sides is/are in contact with the bolster on the heavy-load condition, so that the overall transverse rigidity is increased, and the capability of bearing the vertical load is improved.

Specifically, only the rubber-metal pad spring in the middle is connected with the frame 3 and the bolster 2 on the no-load condition, the bolster transmits the vertical load to the frame via the rubber-metal pad spring in the middle, and the frame transmits the transverse load to the bolster via the rubber-metal pad spring in the middle. Therefore, when the vertical load is smaller, the transverse shearing rigidity is very small, and the stability of the empty vehicle running at a high speed is guaranteed. On the other hand, as only the rubber-metal pad spring in the middle is connected with the frame and the bolster, the vertical deflection of the whole rubber-metal pad spring group is relatively large, and the safety of the vehicle running at a high speed and the adaptability of the vehicle to the tracks is improved. On the heavy-load condition, the rubber-metal pad spring in the middle is compressed, the rubber-metal pad springs at two sides are in contact with the bolster, and the vertical load and the transverse load are born by the three rubber-metal pad springs together, therefore, the bearing capability of the rubber-metal pad spring group is improved, the requirement on the transverse rigidity is met, and the safety of the vehicle running at a high speed is improved.

In practical application, persons skilled in the art can set the number of the rubber-metal pad spring and the free height of each rubber-metal pad spring as desired, and the rubber-metal pad spring group has two or more stages of rigidities in the vertical and transverse directions simply by making one rubber-metal pad spring different from other rubber-metal pad springs in height on the no-load condition, thereby meeting the requirement on rigidity on the actual working conditions. According to this embodiment, the rubber-metal pad spring group has two or more stages of rigidities in both the vertical direction and the transverse direction due to the arrangement of the plurality of the rubber-metal pad springs with different free heights. On the light-load or no-load working condition, the vertical deflection is larger so that the safety of the vehicle running at a high speed and the adaptability of the vehicle to the tracks are improved, and the transverse rigidity is smaller so that the dynamics stability of the empty vehicle is higher; on the heavy-load condition, the transverse rigidity is larger, so that the carrying capability of the rubber-metal pad spring group is improved, the requirement on the transverse rigidity is met, and the safety of the vehicle running at a high speed is improved. Therefore, the central suspension device with multiple stages of rigidities in the transverse and vertical directions in this embodiment is convenient for the mutual shift of different rigidities when the vehicle is empty or heavily loaded, thereby being applicable to fast railway vehicles for safely and stably running.

Figure 7:
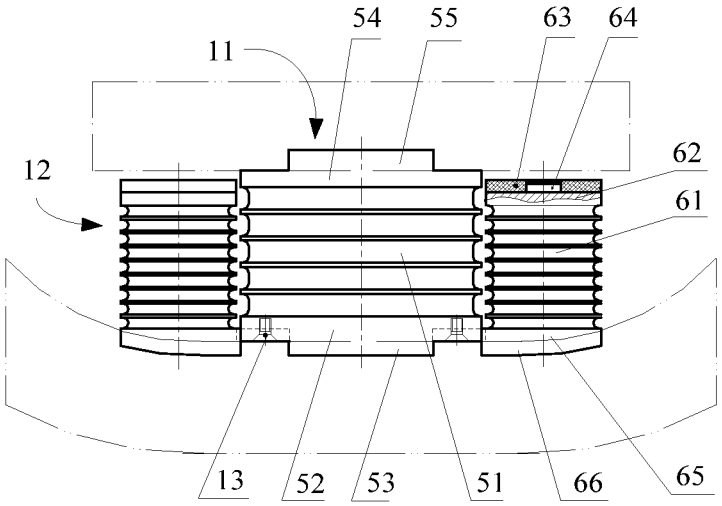
FIG. 7 is a front view of the rubber-metal pad spring group of the central suspension device according to Embodiment II of the present invention.
Figure 8:
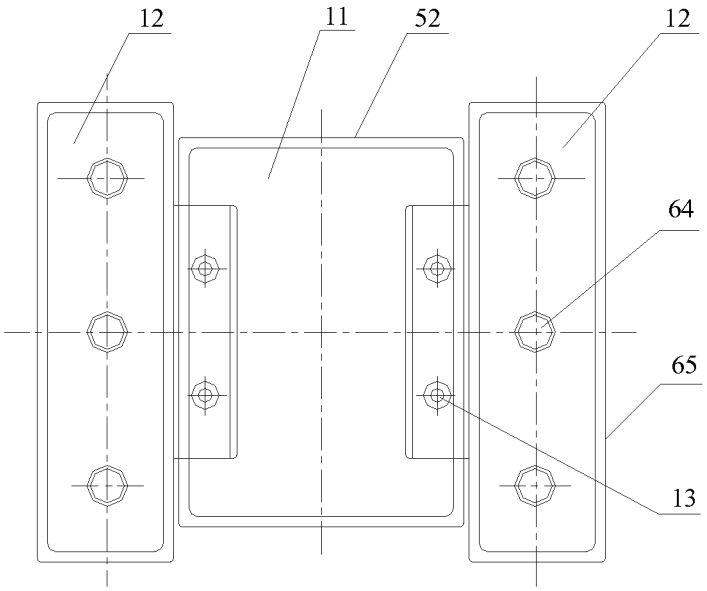
FIG. 8 is a top view of the rubber-metal pad spring group in FIG. 7.
Figure 9:
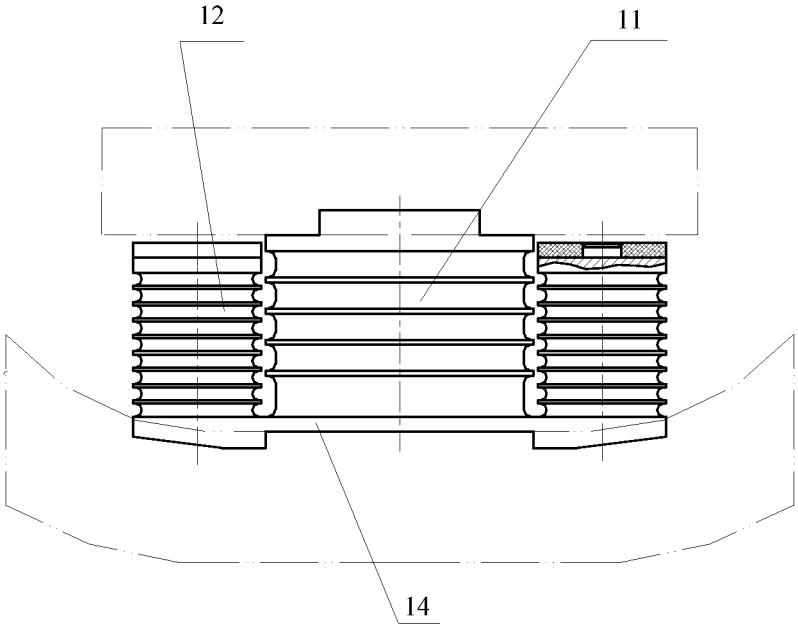
FIG. 9 is a front view of the integrated structure of a first bottom plate and a second bottom plate in the embodiment shown in FIG. 7.
Figure 10:
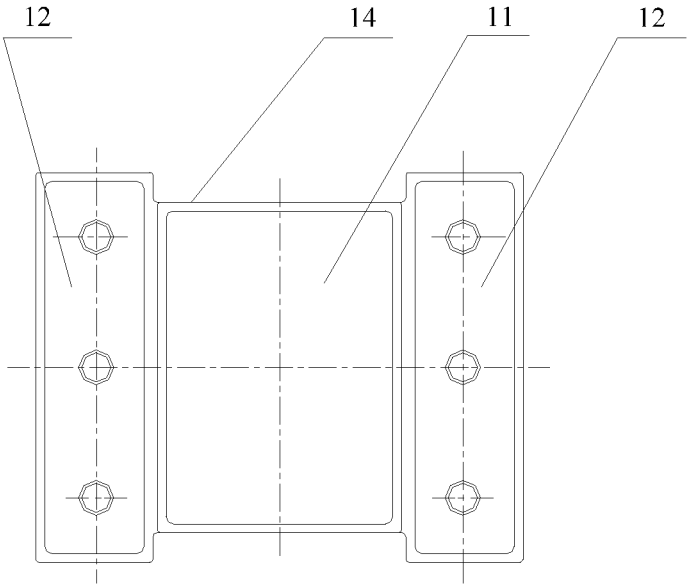
FIG. 10 is a top view of the integrated structure of the first bottom plate and the second bottom plate in FIG. 9.

FIG. 7 is a front view of the rubber-metal pad spring group in the central suspension device according to Embodiment II of the present invention. FIG. 8 is a top view of the rubber-metal pad spring group in FIG. 7. FIG. 9 is a front view of the integrated structure of a first bottom plate and a second bottom plate in the embodiment shown in FIG. 7. FIG. 10 is a top view of the integrated structure of the first bottom plate and the second bottom plate in FIG. 9. As shown in FIGS. 7-10, on the basis of the embodiment I shown in FIG. 6, the rubber-metal pad spring group 10 of this embodiment comprises a second rubber-metal pad spring 11 and two first rubber-metal pad springs 12, wherein the first rubber-metal pad springs 12 are arranged at two sides of the second rubber-metal pad spring 11, the top end of the second rubber-metal pad spring 11 is connected with the bolster 2 represented by the dotted line box above the rubber-metal pad spring group in FIG. 7, each first rubber-metal pad spring 12 comprises a first rubber body 61, a first bottom plate 65, a top surface wearing plate 63, a first upper liner 62 and a first positioning pin 64, wherein the first bottom plate 65 is fixedly connected with the bottom end of the first rubber body 61, the first upper liner 62 is fixedly connected with the top end of the first rubber body 61, the top surface wearing plate 63 is fixedly connected to the first upper liner 62 via the first positioning pin 64, the edge of the first bottom plate 65 is provided with a lower flange 66 used for restricting rotational or transverse movement of the first bottom plate 65 relative to the frame 3, the frame 3 is represented by the dotted line box below the rubber-metal pad spring group in the FIG. 7, and a gap exists between the top surface wearing plate 63 and the bolster 2.

In this embodiment, the second rubber-metal pad spring 11 comprises a second rubber body 51, a second top plate 54 and a second bottom plate 52, wherein the second bottom plate 52 is fixedly connected with the bottom end of the second rubber body 51, the second top plate 54 is fixedly connected with the top end of the second rubber body 51, the edge of the second top plate 54 is provided with an upper flange 55 used for restricting rotational or transverse movement of the second top plate relative to the bolster 2, the edge of the second bottom plate 52 is provided with a lower flange 53 used for restricting rotational or transverse movement of the second bottom plate 52 relative to the frame 3. For positioning purpose, the lower flange 66 is arranged at the edge of the first bottom plate 65, the upper flange 55 is arranged at the edge of the second top plate 54, and the lower flange 53 is arranged at the edge of the second bottom plate 52, so that the rotational and transverse movements between the rubber-metal pad springs and the frame/the bolster can be prevented, the rotation problem in the prior art resulting from the connecting of the positioning pin in the circumferential direction is avoided, meanwhile, the wearing of a connecting unit is reduced, the welding connection is avoided due to the integrated structure of the flanges and the bottom plate or the top plate, and the connecting reliability is improved.

In a specific application, the second bottom plate 52 and the first bottom plate 65 can be arranged separately or connected together. In FIG. 8 and FIG. 10, the second bottom plate 52 and the first bottom plate 65 are connected together. In use, the second bottom plate 52 and the first bottom plate 65 can be fixedly connected by adopting a connecting unit such as a screw 13 as shown in FIG. 8 or a bottom plate 14 with an integrated structure formed by the second bottom plate 52 and the first bottom plate 65 as shown in FIG. 9 and FIG. 10. Connecting the second bottom plate and the first bottom plate together is beneficial to integral positioning.

In practical application, the vehicle is subjected to transverse impact force from the tracks when running in curved tracks, the transverse force acting on a wheel set is transmitted by the frame to the rubber-metal pad spring via the lower flange, and is then transmitted to the bolster via the upper flange after being buffered by the rubber-metal pad spring, so that the transverse load is transmitted and alleviated. Particularly, on the light-load condition, the free height of the first rubber-metal pad springs 12 at two sides are smaller, the top ends of the first rubber-metal pad spring are not in contact with the bolster, the second rubber-metal pad spring 11 in the middle bears the transverse load and the vertical load, specifically, the second rubber-metal pad spring 11 in the middle is connected with the bolster 2 in a positioning way by the upper flange 55 and is connected with the frame 3 in a positioning way by the lower flange 53, and the vertical load is transmitted by the bolster 2 to the second rubber-metal pad spring 11 in the middle and is then transmitted to the frame 3; and the transverse load is transmitted by the frame 3 to the second rubber-metal pad spring 11 in the middle via the lower flange 53, then transmitted to the upper flange 55, and is finally transmitted to the bolster 2 by the upper flange 55. Therefore, when the vertical load is smaller, the transverse shearing rigidity is very small, and the stability of the empty vehicle running at a high speed is guaranteed. On the heavy-load condition, the second rubber-metal pad spring 11 and the first rubber-metal pad springs 12 at two sides bear the vertical load and the transverse load together. The second rubber-metal pad spring 11 uses the same acting force transmission method as that used by the empty vehicle. The first rubber-metal pad springs 12 at two sides are connected with the frame 3 in a positioning way via the lower flange 66, the first rubber-metal pad springs 12 at two sides and the second rubber-metal pad spring 11 in the middle are connected with the bottom plate via the screw 13 or are connected together via the bottom plate 14 with an integrated structure, the top surface wearing plate 63 of each of the first rubber-metal pad springs 12 at two sides and the first positioning pin 64 are in interference press-fit, and the top surface wearing plates 63 can be made of a nonmetal material, so that the friction between the bolster and the top surface wearing plates 63 is increased. Due to the friction between the nonmetal top surface wearing plates 63 and the bolster, the transverse shearing deformation of the first rubber-metal pad springs 12 at two sides can be realized, the vertical bearing capability is guaranteed, and the requirement on the transverse rigidity is met, so that the requirement on the high-speed safe running of the heavy vehicle is guaranteed.

On the basis of the technical effect achieved by Embodiment I, in this embodiment, by adopting the method that the rubber-metal pad spring is positioned with the upper flange integrated with the top plate or the lower flange integrated with the bottom plate, the rotation and the transverse movement between the rubber-metal pad spring and the frame/the bolster can be prevented, so that the probability of rotation of the rubber-metal pad spring in the circumferential direction is avoided, the wearing is reduced, welding connection is avoided due to the integrated structure of the flanges and the bottom plate or the top plate, thereby improving the connecting reliability; meanwhile, on the light-load or no-load condition, the upper flange and the lower flange are used to transmit the transverse acting force, so that the transverse shearing rigidity is very small, and the stability of the vehicle running at a high speed is guaranteed; due to the friction between the nonmetal top surface wearing plate and the bolster, the transverse shearing deformation is achieved, so that the vertical bearing capability is guaranteed, the requirement on the transverse rigidity is met, and the requirement on the high-speed safe running of the heavy vehicle is guaranteed.

Figure 11:
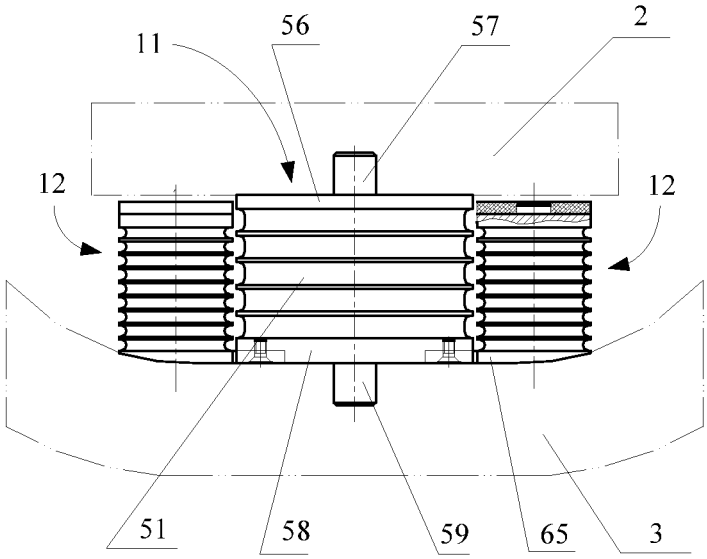
FIG. 11 is a schematic diagram of a positioning structure of the second rubber-metal pad spring in the embodiment shown in FIG. 7.

FIG. 11 is a schematic diagram of a positioning structure of the second rubber-metal pad spring in the embodiment shown in FIG. 7. As shown in FIG. 11, in Embodiment II, the second rubber-metal pad spring 11 and the bolster 2 as well as the second rubber-metal pad spring 11 and the frame 3 also can be positioned by a positioning pins known in the prior art. Particularly, the second rubber-metal pad spring 11 comprises the second rubber body 51, a second upper liner 56, a second upper positioning pin 57 fixedly connected with the second upper liner 56, a second lower liner 58, and a second lower positioning pin 59 fixedly connected with the second lower liner 58; the bottom end of the second rubber body 51 is fixedly connected with the second lower liner 58, the second lower liner 58 is connected with the frame 3 via the second lower positioning pin 59, the top end of the second rubber body 51 is fixedly connected with the second upper liner 56, the second upper liner 56 is connected with the bolster 2 via the second upper positioning pin 57, and the second lower liner 58 is connected with the first bottom plate 65. In Embodiment II, the second rubber-metal pad spring can use the positioning pins for positioning or use the combination of the positioning pins and the flanges for positioning; as for the positioning method using the positioning pins, the working principles and effects are similar to those of the prior art, and no further details are given here.

Figure 12:
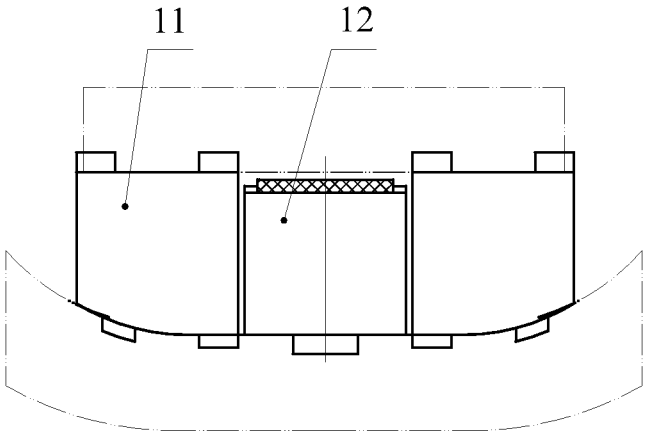
FIG. 12 is a front view of the rubber-metal pad spring group of the central suspension device according to in Embodiment III of the present invention.

FIG. 12 is a front view of the rubber-metal pad spring group in the central suspension device according to Embodiment III of the present invention. As shown in FIG. 12, Embodiment III differs from the rubber-metal pad spring group shown in FIG. 7 in the following aspects that: only one first rubber-metal pad spring 12 is arranged in the middle, and two second rubber-metal pad springs 11 are arranged at two sides of the first rubber-metal pad spring 12, that is, the top ends of the two rubber-metal pad springs at two sides are connected with the bolster, and a gap exists between the rubber-metal pad spring in the middle and the bolster, similarly, the first rubber-metal pad spring 12 is only in contact with the bolster on the heavy-load condition to bear the transverse force and the vertical force, so that the two stages of rigidities can be mutually adjusted on the light-load condition and the heavy-load condition, the working principles and effects are similar, and no further details are given here.

In any one of the above described embodiments, the rubber-metal pad spring in the rubber-metal pad spring group can be of cuboid or cylindrical shape. The shape of the rubber-metal pad spring group can be reasonably selected according to the different requirements on rigidities in specific applications.

The central suspension device in any one of the above described embodiments is limited to comprise a frame, a bolster, a longitudinal traction connecting rod device and a rubber-metal pad spring group. In practical application, the central suspension device also can be limited to comprise a rubber-metal pad spring group only. The rubber-metal pad spring group is composed of at least two rubber-metal pad springs. The bottom end of each rubber-metal pad spring is connected with the frame, the top end of at least one rubber-metal pad spring in the rubber-metal pad spring group is connected with a bolster, and a gap exists between the top end of at least one rubber-metal pad spring and the bolster. The central suspension device only comprising the rubber-metal pad spring group can be arranged between a frame and a bolster of the wagon bogie. Further, the rubber-metal pad spring group and connections between the rubber-metal pad spring group and a frame, a bolster and a longitudinal traction connecting rod device in the central suspension device only comprising the rubber-metal pad spring group are same as any one of the above described embodiments. Correspondingly, a wagon bogie in such case can be limited to comprise an axle box suspension device, a frame, a bolster and a longitudinal traction connecting rod device, wherein one end of the longitudinal traction connecting rod device is connected with the frame, the other end of the longitudinal traction connecting rod device is connected with the bolster. The axle box suspension device is connected with the central suspension device via the frame. The working principles and the achieved technical effects compared with the prior art are similar with any one of the above described embodiments, and no further details are given here.

Figure 13:
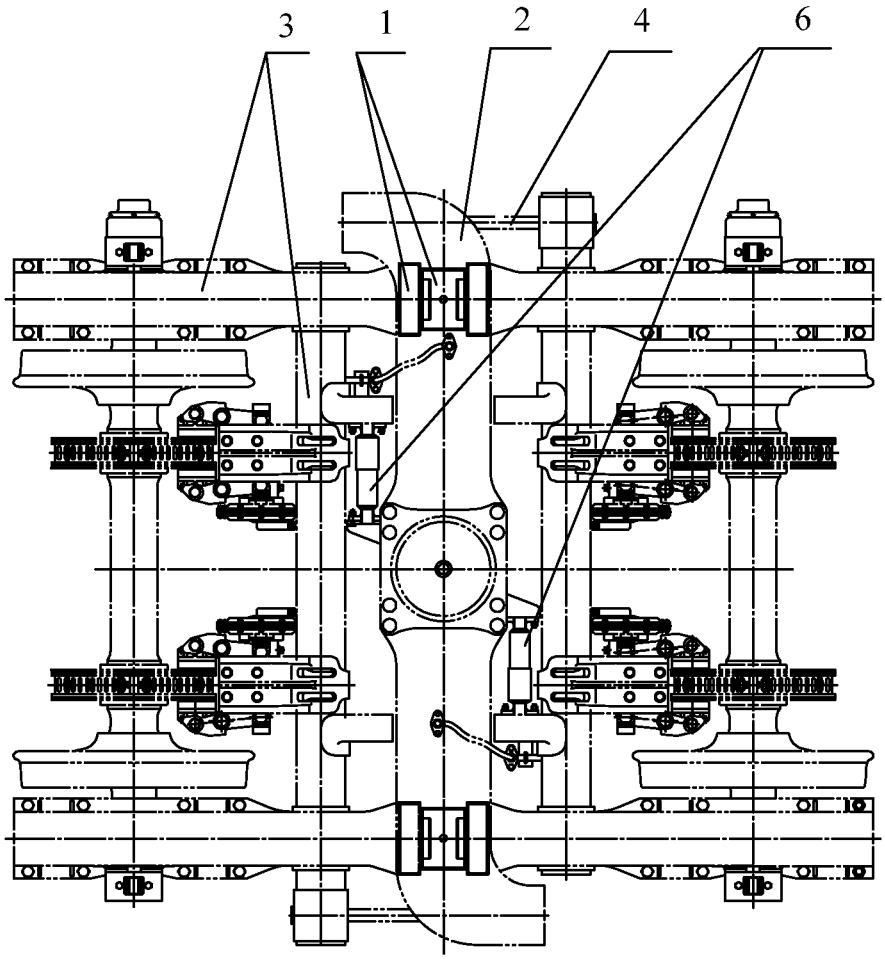
FIG. 13 is a top view of the wagon bogie according to Embodiment I of the present invention.
Figure 14:
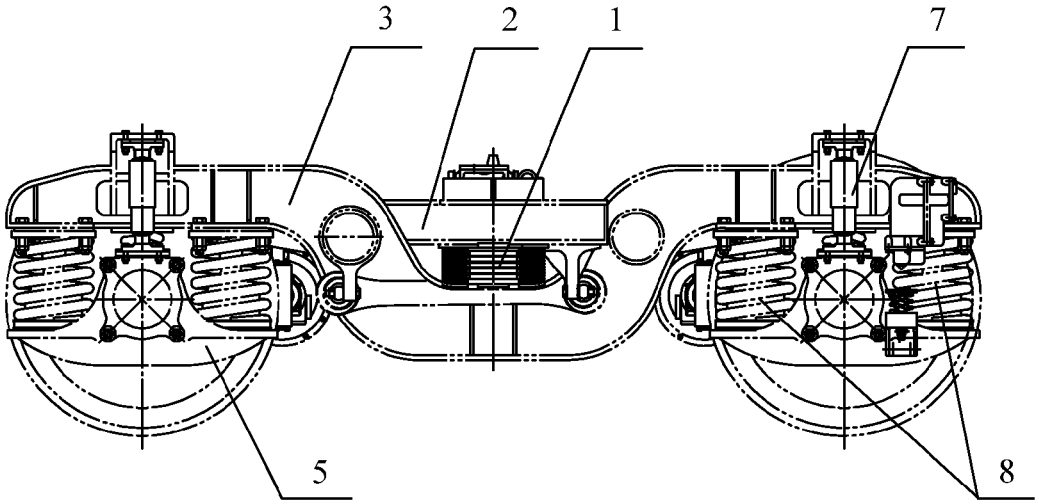
FIG. 14 is a front view of the wagon bogie in FIG. 13.

FIG. 13 is a top view of the wagon bogie according to Embodiment I of the present invention. FIG. 14 is a front view of the wagon bogie shown in FIG. 13. As shown in FIG. 13 and FIG. 14, the central suspension device of this embodiment can be any of the central suspension devices shown in FIGS. 6-12. The wagon bogie of this embodiment comprises an axle box suspension device and the above central suspension device. One end of a longitudinal traction connecting rod device 4 is connected with a frame 3, the other end of the longitudinal traction connecting rod device 4 is connected with a bolster 2, and the axle box suspension device is connected with the central suspension device via the frame 3. The axle box suspension device comprises an axle box assembly 5, a vertical damper 7 and an axle box spring group 8. The vertical damper 7 can use hydraulic vibration attenuation, so that the vibration of the wheel set on the frame 3 can be better alleviated when different loads are born in the vertical direction, and the fatigue life of the frame 3 is prolonged. A transverse damper 6 is further connected between the frame 3 and the bolster 2 and is used for improving the transverse dynamics performances of the vehicle running at a high speed.

This embodiment can implement the technical solutions of any one of the above embodiments of the central suspension device, the working principles and the achieved technical effects are similar, and no further details are given here.

Figure 15:
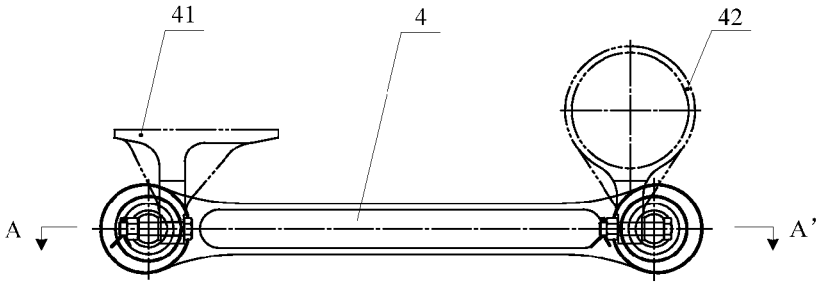
FIG. 15 is a schematic structural diagram of the longitudinal traction connecting rod device of the wagon bogie in the embodiment shown in FIG. 13.
Figure 16:
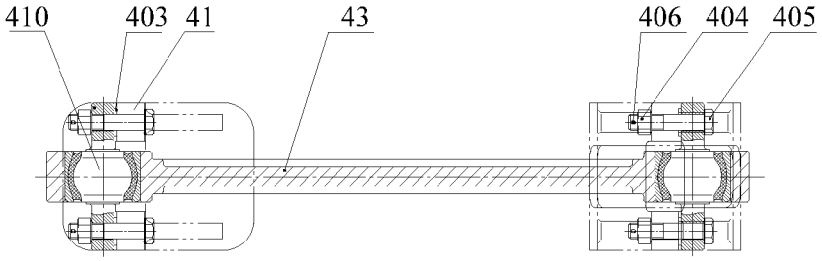
FIG. 16 is a section view of the longitudinal traction connecting rod device in the A-A' direction in FIG. 15.
Figure 17:
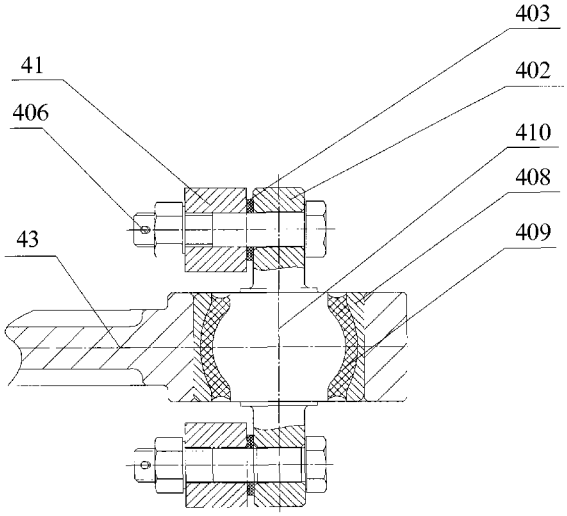
FIG. 17 is a schematic structural diagram of a spherical hinge assembly in FIG. 16.

FIG. 15 is a schematic structural diagram of the longitudinal traction connecting rod device of the wagon bogie in the embodiment shown in FIG. 13. FIG. 16 is a section view of the longitudinal traction connecting rod device in the A-A' direction shown in FIG. 15. FIG. 17 is a schematic structural diagram of the spherical hinge assembly in FIG. 16. As shown in FIGS. 15-17, in this embodiment, the longitudinal traction connecting rod device 4 comprises two spherical hinge assemblies 410 and a traction connecting rod 43 connected between the two spherical hinge assemblies 410, wherein one spherical hinge assembly is connected with a first traction connecting rod base 42 arranged on the frame 3, the other spherical hinge assembly is connected with a second traction connecting rod base 41 arranged on the bolster 2, each spherical hinge assembly 410 comprises a spherical hinge shaft 402 and a spherical hinge sleeve 408, and the inner side surfaces of the spherical hinge shaft 402 and the spherical hinge sleeve 408 are matched in an articulating way by a spherical curve. The middle part of each spherical hinge shaft 402 is provided with a convex spherical surface, each spherical hinge sleeve 408 is provided with a concave spherical surface, the convex spherical surface and the concave spherical surface are matched with each other, the end part of the spherical hinge shaft 402 of one spherical hinge assembly 410 is connected with the first traction connecting rod base 42, the end part of the spherical hinge shaft 402 of the other spherical hinge assembly 410 is connected with the second traction connecting rod base 41, and each spherical hinge assembly is connected with the traction connecting rod 43 by each spherical hinge sleeve 408.

In practical application, the end parts of the spherical hinge shafts 402 are connected with the first traction connecting rod base 42 and the second traction connecting rod base 41 via bolts 405 and nuts 404, a cotter pin 406 is further arranged on each bolt 405 to prevent the nut 404 from slipping off the bolt 405. In order to guarantee the performances of the bogie, the position of the bolster needs to be adjusted during the assembling of the bolster. In this embodiment, adjustment pads 403 are further arranged between each spherical hinge shaft 402 and the first traction connecting rod base 42 as well as between the spherical hinge shaft 402 and the second traction connecting rod base 41, so as to facilitate adjusting the position of the bolster 2 during the assembling process. Adjustment pads 403 of different thicknesses can be selected as desired. When the transverse force is transmitted to the spherical hinge shafts 402 at one end of the longitudinal traction connecting rod device 4 via the first traction connecting rod base 42, the spherical hinge shafts 402 can rotate a certain angle relative to the spherical hinge sleeves 408 so as to reduce the transverse shearing deformation, thereby providing smaller transverse rigidity and being beneficial for reducing the transverse additional rigidity of the bogie.

A hinge intermediate sleeve 409 with an elastic structure is arranged between the matched surface of each spherical hinge shaft 402 and each spherical hinge sleeve 408, and the hinge intermediate sleeves can be made of rubber, so that the spherical hinge assemblies 410 can have larger elastic deformation, meanwhile, convenience is also provided for the maintenance of the spherical hinge assemblies. The traction connecting rod 43 is provided with an installation hole (not marked) and can be formed by casting or forging, the outer side surface of each spherical hinge sleeve 408 is engaged with the installation hole in interference fit, the spherical hinge sleeves 408 and the traction connecting rod 43 can be connected into a whole by enough pre-tightening force during the installation of the longitudinal traction connecting rod device, so that the acting forces from all directions of the bolster can be transmitted to the spherical hinge assemblies 410 via the traction connecting rod 43, then to the frame by the spherical hinge assemblies 410, and finally to the wheel set.

By adopting the longitudinal traction connecting rod device with the spherical hinge structure, the problem that the nuts become loose easily due to the deformation of rubber pad assemblies in the prior art is solved, the problem of wearing between each inner cylinder and the traction connecting rod is also solved, meanwhile, the process of manufacturing screw threads on the traction connecting rod is avoided, the manufacture cost for the longitudinal traction connecting rod device is reduced, in addition, the potential safety hazard caused by the defects in the process of manufacturing the screw threads is avoided.

On the basis of achieving the technical effects of any one of the above embodiments of the central suspension device, this embodiment further realizes the transmission of the acting force between the bolster and the frame by adopting the longitudinal traction connecting rod device composed of the structure of the spherical hinge assemblies, so that the transverse shearing deformation is reduced, smaller transverse rigidity is provided, the transverse additional rigidity of the bogie can be favorably reduced, the maintenance and the installation are further facilitated, and the installation difficulty and the manufacture cost are reduced. By adopting the central suspension device with two stages of rigidities in the vertical and transverse directions during the heavy load of the vehicle and the longitudinal traction connecting rod device with the spherical hinge structure, the verification results of dynamic simulation theoretical calculation, roll vibration test and track test show that the transverse rigidity of the empty vehicle can be reduced by 50%-70%, and the critical speed of the empty vehicle can be increased by 40-80 km/h, therefore, the technical difficulty of high-speed running stability of the empty vehicle is effectively overcome, the technical problem of vertical loading on the heavy-load condition is also solved, and the safety of the heavy vehicle running at a high speed can be guaranteed.

Figure 5:
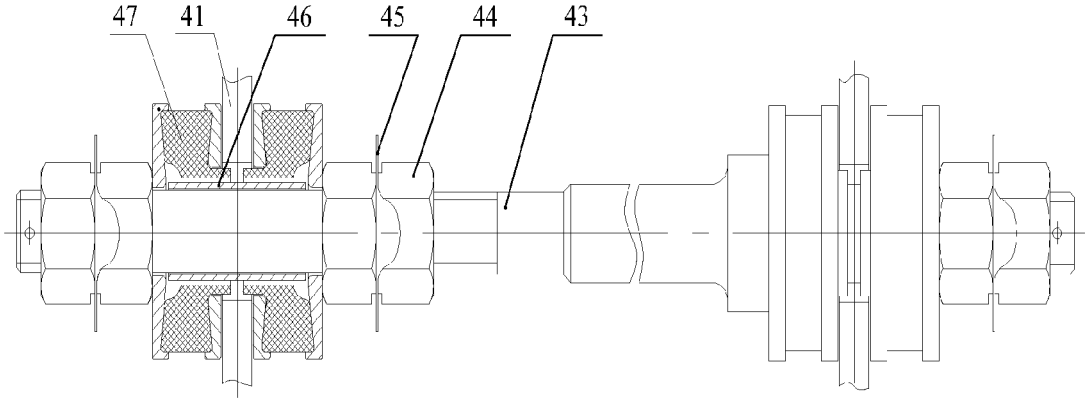
FIG. 5 is a schematic structural diagram of the longitudinal traction connecting rod device in FIG. 1.

The longitudinal traction connecting rod device 4 in the above embodiment of the wagon bogie can also use the structural form in the prior art shown in FIG. 5, that is, the longitudinal traction connecting rod device 4 comprises two rubber pad assemblies 47 and the traction connecting rod 43 connected between the two rubber pad assemblies 47, one of the two rubber pad assemblies is connected with the first traction connecting rod base 42 arranged on the frame 3, the other rubber pad assembly is connected with the second traction connecting rod base 41 arranged on the bolster 2, and the two rubber pad assemblies are respectively fixed at the two ends of the traction connecting rod 42 by the nuts 44. An inner cylinder 46 for reducing wearing is arranged between each rubber pad assembly 47 and the traction connecting rod 43, and the inner cylinder 46 is in clearance fit with the traction connecting rod 43 to reduce the wearing generated by the relative movement of the inner cylinder 46 and the traction connecting rod 43, the working principles and the technical effects of the longitudinal traction connecting rod device with the structural form are similar to those of the prior art, and no further details are given here.

Figure 18:
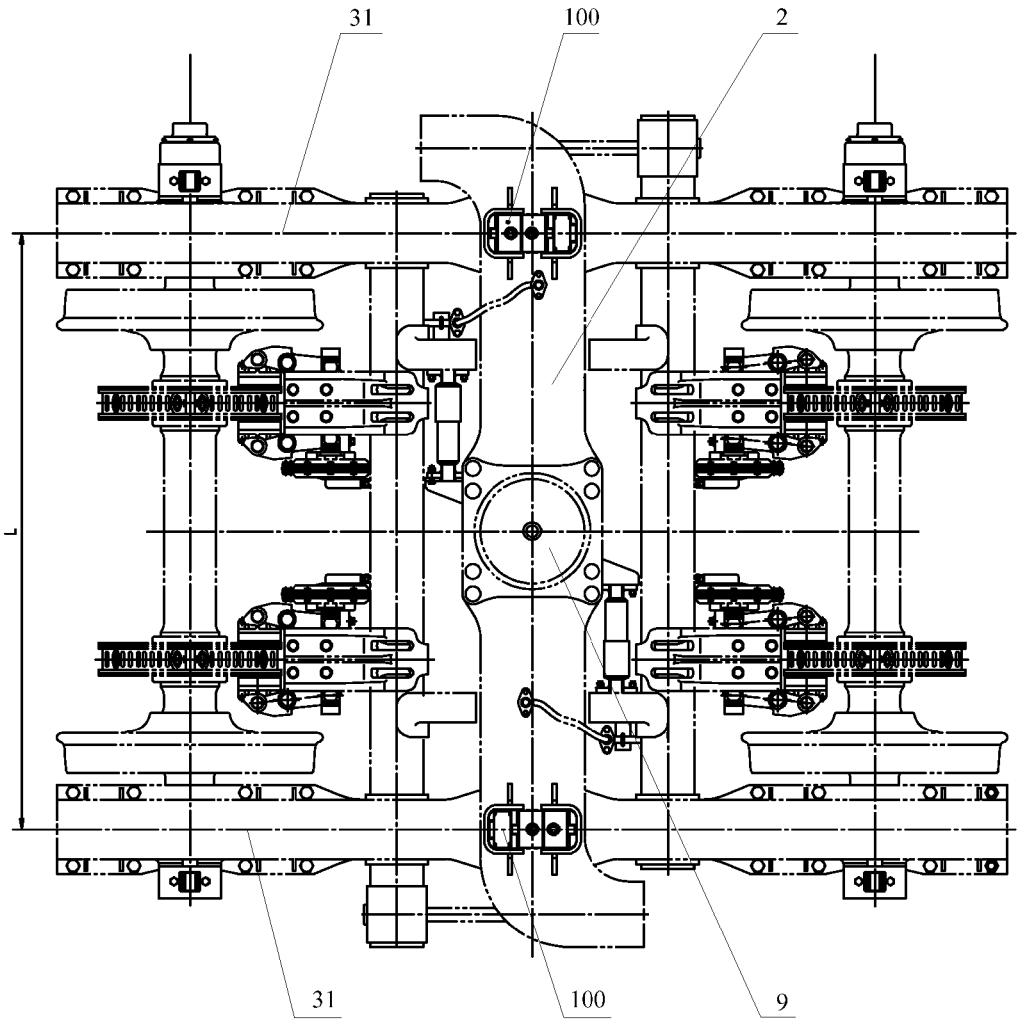
FIG. 18 is a schematic structural diagram of the wagon bogie according to Embodiment II the present invention.

FIG. 18 is a schematic structural diagram of the wagon bogie according to Embodiment II of the present invention. In this embodiment, the center of the bolster 2 is provided with a bogie center plate 9, the bolster 2 is provided with two side bearings 100 which are symmetrically arranged relative to the bogie center plate 9, and the distance L between centers of the two side bearings 100 is more than 1520 mm. The distance between centers of the two side bearings 100 in the prior art is generally 1520 mm, so that the room for increasing the critical speed of the vehicle is limited. In this embodiment, as the distance between centers of the two side bearings 100 is more than 1520 mm, on one hand, this is in favor of increasing the moment against turning of the side bearings so as to increase the running speed of the vehicle, on the other hand, the anti-roll tilt angle of the vehicle can be reduced so as to be beneficial for the running safety of the wagon.

Particularly, the moment against turning of the side bearings is in direct proportion to the distance between centers of the two side bearings, the frictional factor of a wearing plate of the side bearings and the pressure born by the side bearings, therefore, the increase in the distance between centers of the side bearings can effectively increase the moment against turning of the side bearings, while the increase in the moment against turning of the side bearings allows to increase the maximum running speed of the vehicle. When the vehicle runs on curved tracks, the vehicle body has the tendency of rolling relative to the bolster, the roll of the vehicle body is prevented through the roll restoring moment formed by the gravity of the vehicle body, a smaller anti-roll tilt angle and a larger roll restoring moment are acquired by increasing the distance between centers of the two side bearings, so that the roll of the vehicle body can be prevented effectively, and the running safety of the vehicle is improved. Preferably, the distance L between centers of the two side bearings is selected as 2000 mm, compared with the 1520 mm of the distance between the two side bearings in the prior art, the moment against turning of the side bearings is increased by 31.6%, and the critical speed of the vehicle is increased by 16%, so that the problem of low maximum running speed of the vehicle is solved, in addition, under the condition that the gap of the side bearings is 5 mm, the anti-roll tilt angle of the vehicle is reduced by 31.5%, and the safety of the vehicle is guaranteed.

Figure 1:
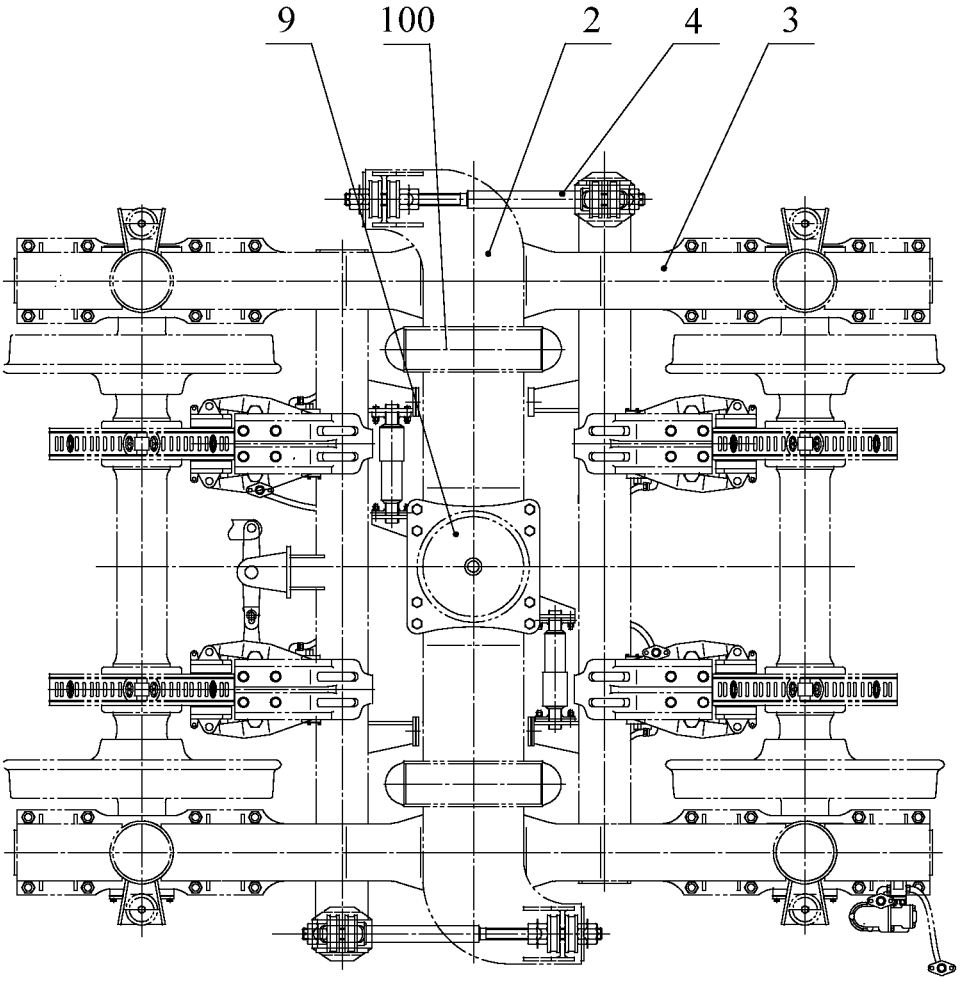
FIG. 1 is a top view of the structure of a wagon bogie in the prior art.
Figure 2:
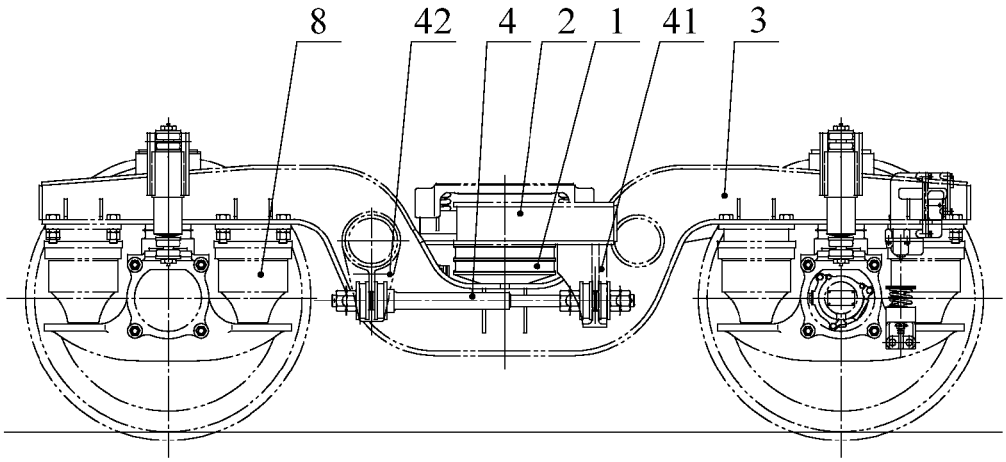
FIG. 2 is a front view of the structure of the wagon bogie in FIG. 1.
Figure 3:
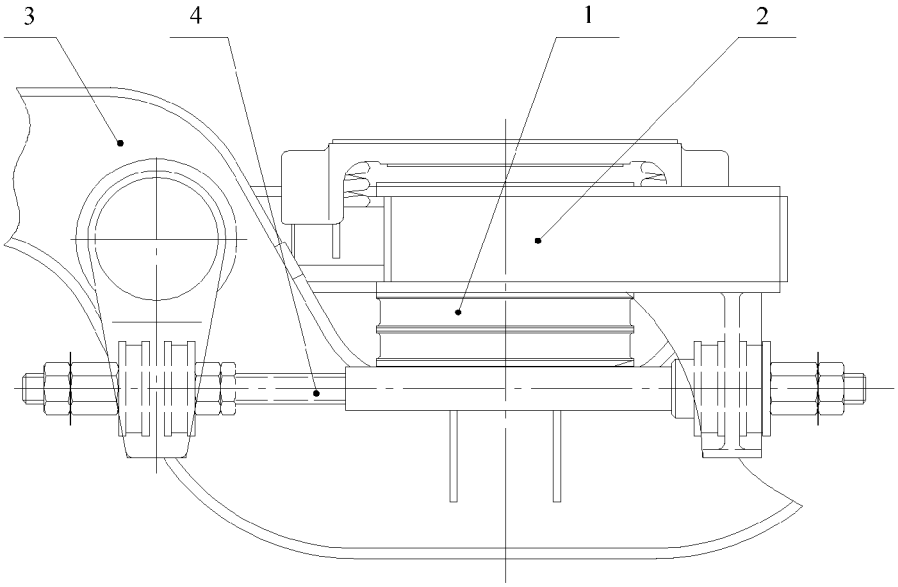
FIG. 3 is a schematic structural diagram of the central suspension device in FIG. 1.
Figure 4:
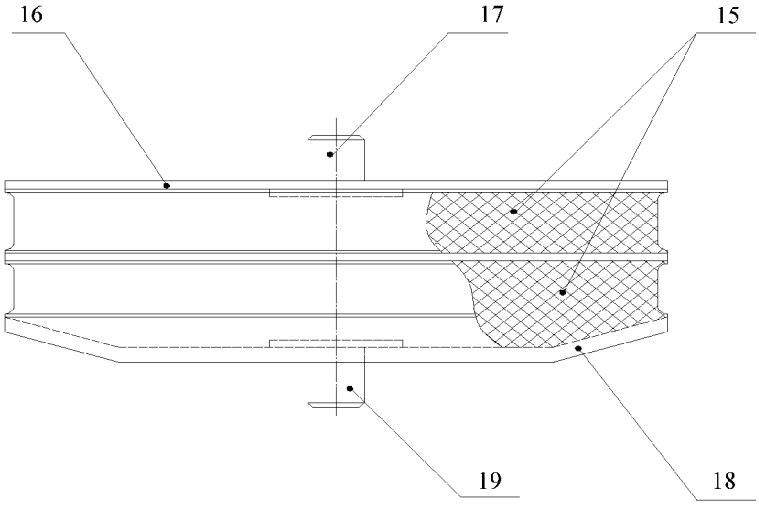
FIG. 4 is a schematic structural diagram of the rubber-metal pad spring in FIG. 3.

In the prior art, the distance between centers of the two side bearings is 1520 mm which is less than the distance between two side beams of the frame of the bogie, as shown in FIG. 1, the two side bearings are arranged on the bolster and located at the inner side of the side beams 31, so that the acting force of the vehicle body exerted on the side bearings 100 can exert the effect of bending moment on the bolster 2; and during the running of the vehicle, the repeated impact accelerates the fatigue failure of the bolster, so that the reliability of the bolster is reduced. In practical application of the invention, preferably, the distance L between the two side bearings is set equal to the transverse distance between the two side beams 31, and the side bearing 100 at each side is positioned right above the side beam 31 of the bogie 3 at the same side, therefore, the effect of bending moment generated by the acting force of the side bearings on the bolster 2 is reduced, and the reliability of the bolster is improved.

Further, on the basis of achieving the technical effects of the above embodiment, this embodiment, by setting the distance between centers of the two side bearings to be more than 1520 mm, efficiently increases the moment against turning, and the maximum running speed of the vehicle is increased due to the increase in the moment against turning of the side bearings, meanwhile, the anti-roll tilt angle is smaller, and the roll restoring moment is larger. Therefore, the roll of the vehicle body can be prevented, and the running safety of the vehicle is improved.

The invention further provides an express railway wagon comprising the wagon bogie according to any one of embodiments shown in FIGS. 13-18. The express railway wagon can be an express railway container wagon, an express box wagon, an express refrigerator wagon or an express car-transport wagon and the like.

Finally, it should be noted that the above embodiments are merely used for illustratively describing the technical solutions of the present invention, but not intended to limit the present invention. Although the present invention has been described in detail with reference to the foregoing embodiments, it should be understood that persons skilled in the art can make modifications to the technical solutions described in the foregoing embodiments or equivalent substitutions of a part of technical features or all of the technical features thereof without creative work, and these modifications or substitutions do not make the essence of their corresponding technical solutions deviate from the scope of the invention as defined in the claims.

What is claimed is:

1. A central suspension device, comprising a frame, a bolster and a longitudinal traction connecting rod device, wherein one end of the longitudinal traction connecting rod device is connected with the frame, and the other end of the longitudinal traction connecting rod device is connected with the bolster, and wherein the central suspension device further comprises a rubber-metal pad spring group composed of at least two rubber-metal pad springs, a bottom end of each of the rubber-metal pad springs is connected with the frame, a top end of at least one rubber-metal pad spring of the rubber-metal pad spring group is connected with the bolster, and a gap exists between a top end of at least one rubber-metal pad spring and the bolster.

2. The central suspension device according to claim 1, wherein the rubber-metal pad spring group comprises a first rubber-metal pad spring and a second rubber-metal pad spring, wherein a top end of the second rubber-metal pad spring is connected with the bolster, the first rubber-metal pad spring comprises a first rubber body, a first bottom plate, a top surface wearing plate, a first upper liner and a first positioning pin, wherein the first bottom plate is fixedly connected with a bottom end of the first rubber body, the first upper liner is fixedly connected with a top end of the first rubber body, the top surface wearing plate is fixedly connected to the first upper liner via the first positioning pin, an edge of the first bottom plate is provided with a lower flange used for restricting rotational or transverse movement of the first bottom plate relative to the frame, and a gap exists between the top surface wearing plate and the bolster.

3. The central suspension device according to claim 2, wherein the second rubber-metal pad spring comprises a second rubber body, a second top plate and a second bottom plate, wherein the second bottom plate is fixedly connected with a bottom end of the second rubber body, the second top plate is fixedly connected with a top end of the second rubber body, an edge of the second top plate is provided with an upper flange used for restricting rotational or transverse movement of the second top plate relative to the bolster, and an edge of the second bottom plate is provided with a lower flange used for restricting rotational or transverse movement of the second bottom plate relative to the frame.

4. The central suspension device according to claim 3, wherein the first bottom plate and the second bottom plate are fixedly connected via a connecting unit.

5. The central suspension device according to claim 3, wherein the first bottom plate and the second bottom plate are in an integrated structure.

6. The central suspension device according to claim 2, wherein the second rubber-metal pad spring comprises a second rubber body, a second upper liner, a second upper positioning pin fixedly connected with the second upper liner, a second lower liner, and a second lower positioning pin fixedly connected with the second lower liner, wherein a bottom end of the second rubber body is fixedly connected with the second lower liner, the second lower liner is connected with the frame via the second lower positioning pin, a top end of the second rubber body is fixedly connected with the second upper liner, the second upper liner is connected with the bolster via the second upper positioning pin, and the second lower liner is connected with the first bottom plate.

7. The central suspension device according to claim 2, wherein two first rubber-metal pad springs are arranged at two sides of the second rubber-metal pad spring, or two second rubber-metal pad springs are arranged at two sides of the first rubber-metal pad spring.

8. The central suspension device according to claim 2, wherein the top surface wearing plate is made of a nonmetal material.

9. The central suspension device according to claim 1 wherein the rubber-metal pad spring is of cuboid or cylindrical shape.

* * * * *